US007300521B2

(12) United States Patent
Bowman et al.

(10) Patent No.: US 7,300,521 B2
(45) Date of Patent: Nov. 27, 2007

(54) WALL SCRUBBER FOR BLOWN INSULATION

(75) Inventors: David J. Bowman, Charlotte, NC (US); Patrick A. Dwyer, Weddington, NC (US); Benjamin D. Underwood, Albermarle, NC (US); David S. Wilburn, Waxhaw, NC (US); Christi L. Kingsley, Denver, NC (US)

(73) Assignee: U.S. Greenfiber, LLC, Charlotte, NC (US)

( * ) Notice: Subject to any disclaimer, the term of this patent is extended or adjusted under 35 U.S.C. 154(b) by 273 days.

(21) Appl. No.: 11/007,641

(22) Filed: Dec. 8, 2004
(Under 37 CFR 1.47)

(65) Prior Publication Data

US 2006/0118038 A1 Jun. 8, 2006

(51) Int. Cl.
*B05C 5/02* (2006.01)
*B65G 53/28* (2006.01)
*B24B 57/02* (2006.01)

(52) U.S. Cl. ..... 118/308; 406/47; 406/48; 406/65; 451/178; 451/259; 451/456

(58) Field of Classification Search ..... 118/308, 118/312, 315, 323; 427/196, 206, 294, 207.1, 427/208.8, 422; 241/101.2; 156/71; 406/47, 406/48, 65, 134, 144; 299/39.2, 39.4, 39.9; 451/178, 259, 456
See application file for complete search history.

(56) References Cited

U.S. PATENT DOCUMENTS 4,149,345 A * 4/1979 Atsuchi ..... 451/87
5,297,363 A * 3/1994 Schroder et al. ..... 451/358
5,403,128 A * 4/1995 Thomas ..... 406/39
5,933,901 A * 8/1999 Nakamura ..... 15/93.4
6,251,476 B1 * 6/2001 Boyer et al. ..... 427/207.1
6,314,695 B1 * 11/2001 Belleau ..... 52/309.17
6,508,697 B1 * 1/2003 Benner et al. ..... 451/443
7,040,967 B2 * 5/2006 Benner ..... 451/56

FOREIGN PATENT DOCUMENTS

WO WO 96/26013 * 8/1996

OTHER PUBLICATIONS

Krendl Wall Cavity Spray-On System, from Internet, www.krendlmachine.com/wallcavitysystems.html, 1998.
Krendl Machine Co., Inc., Model #349B, Wall Scrubber Parallel Handle, Jul. 1996.

* cited by examiner

*Primary Examiner*—Laura Edwards
(74) *Attorney, Agent, or Firm*—MacCord Mason PLLC

(57) ABSTRACT

An insulation system comprising: a supply of material having discrete elements; an applicator assembly for installation of the material having discrete elements to a surface; and a scrubber for finishing the face of the material, the scrubber including: (a) a vacuum conduit; (b) a blade assembly attached to the vacuum conduit; (c) a drive for the blade assembly; and (d) a vacuum substantially adjacent the face of the material during finishing. In the one embodiment, the system comprises a transporter system downstream of the supply of material having discrete elements for delivery of the material to the applicator assembly. Also, in one embodiment, the blade assembly comprises an axis of rotation perpendicular to the face of the material during finishing.

33 Claims, 4 Drawing Sheets

16

WALL SCRUBBER FOR BLOWN INSULATION

BACKGROUND OF THE INVENTION (1) Field of the Invention

The present invention relates generally to insulation systems, and, more particularly, to a rotary scrubber for finishing the face of material having discrete elements.

(2) Description of the Prior Art

Insulation is used in residential and commercial dwellings both to conserve energy and to reduce noise. The two most common types of insulation are blown and batt. Blown insulation may be made from several lightweight natural or man-made materials. With the use of adhesives to bond the material, blown loose fill insulation may now be used on many different surfaces, including cavities formed between wall studs. When the blown insulation is installed in such a cavity, the surface of the insulation often needs to be finished in order to eliminate the protruding insulation before the drywall is installed. The wall studs may also need to be cleaned for this same purpose.

One current method used for completing this task includes scrubbing off the excess insulation from the surface with the use of a scrubber or planer, causing the excess material to fall to the floor to be swept or vacuumed up at a later time. This process has several disadvantages. First, the process is inefficient in that it demands two steps: removing the excess material and cleaning up the material at a later time. Another inconvenience of the current process is that the use of reclaim material can cause variations in finished wall moisture content and handling characteristics. Furthermore, the material may also have accumulated undesirable particulates and such from lying on the floor.

Thus, there remains a need for a new and improved process of finishing and removing the surface of blown insulation that can reduce or eliminate the labor of removing the excess material and work site cleanup, and can reclaim material that may be ready for reinstallation.

SUMMARY OF THE INVENTION

The present invention is directed to an insulation system comprising: a supply of material having discrete elements; an applicator assembly for installation of the material having discrete elements to a surface; and a scrubber for finishing the face of the material. The scrubber may include: (a) a vacuum conduit; (b) a blade assembly attached to the vacuum conduit; (c) a drive for the blade assembly; and (d) a vacuum substantially adjacent the face of the material during finishing. In one embodiment, the system may include a transporter system downstream of the supply of material having discrete elements for delivery of the material to the applicator assembly. Also, in one embodiment, the blade assembly may include an axis of rotation perpendicular to the face of the material during finishing.

In one embodiment, the supply of material having discrete elements may be selected from the group consisting of fibrous material, granular material, pellet material, agglomerated material, aggregated material and mixtures thereof. The supply of material having discrete elements may be inorganic. Preferably, the inorganic material is selected from the group consisting of fiberglass, rock wool, pearlite, mineral wool, asbestos, and mixtures thereof. The supply of material having discrete elements may be organic. Preferably, the organic material is a natural material such as cellulose.

In one embodiment, the supply of material having discrete elements is a non-conductive material. The supply of non-conductive material may be a thermally non-conductive material, an acoustically non-conductive material, an electrically non-conductive material, or mixtures thereof. The supply of material may further include material that has been reclaimed and recycled through the insulation system.

The applicator assembly may include: a nozzle having an inlet for receiving the material and an outlet for applying the material to a surface; and an adhesive applicator adjacent to the nozzle for activating a substantially water-free adhesive to provide structure to the material having discrete elements during installation.

Preferably, the adhesive applicator may include a supply of adhesive material and a spray head for supplying adhesive to the material having discrete elements. The supply of adhesive material may also include a hot melt adhesive and a heater assembly. The hot melt adhesive may be a thermoplastic adhesive.

In the preferred embodiment, the vacuum conduit may include at least one inlet and at least one outlet. Preferably, the open area of the inlet may be greater than the open area of the outlet. In one embodiment, the vacuum conduit may also include a transition zone between the inlet and the outlet.

Also in the preferred embodiment, the blade assembly has a contact surface substantially parallel to the face of the material during finishing. Preferably, the axis of rotation of the blade assembly may be substantially perpendicular to the face of the material during finishing. In one embodiment, the blade assembly may include scalloped edges. Also, the blade assembly may include sidewall cutters. Further, the blade assembly may include an elastomeric surface. The blade assembly may also include an angled edge.

In the preferred embodiment, the drive may be an external drive. Preferably, the drive may be a belt drive or a timing belt drive.

Preferably, the scrubber may further include a positioner attached to the vacuum conduit for moving the apparatus with respect to the face of the material. The positioner may include at least one handle.

In one embodiment, the vacuum may include a vacuum source attached to the vacuum for removing loose material created during finishing.

Accordingly, one aspect of the present invention is to an insulation system comprising: a supply of material having discrete elements; an applicator assembly for installation of the material having discrete elements to a surface; and a scrubber for finishing the face of the material, wherein the scrubber includes a vacuum substantially adjacent the face of the material during finishing.

Another aspect of the present invention is to provide a scrubber for finishing the face of a material having discrete elements, the apparatus comprising: a vacuum conduit; a blade assembly attached to the vacuum conduit, the blade assembly utilizing an axis of rotation substantially perpendicular to the face of the material during finishing; a drive for the blade assembly; and a vacuum substantially adjacent the face of the material during finishing.

Still another aspect of the present invention is to provide an insulation system comprising: a supply of material having discrete elements; an applicator assembly for installation of the material having discrete elements to a surface; a transporter system downstream of the supply of material having discrete elements for delivery of the material to the applicator assembly; and (d) a scrubber for finishing the face of the material, the scrubber including: (a) a vacuum conduit;

(b) a blade assembly attached to the vacuum conduit, the blade assembly utilizing an axis of rotation substantially perpendicular to the face of the material during finishing; (c) a drive for the blade assembly; and (d) a vacuum substantially adjacent the face of the material during finishing.

These and other aspects of the present invention will become apparent to those skilled in the art after a reading of the following description of the preferred embodiment when considered with the drawings.

DESCRIPTION OF THE PREFERRED EMBODIMENTS

Figure 1:
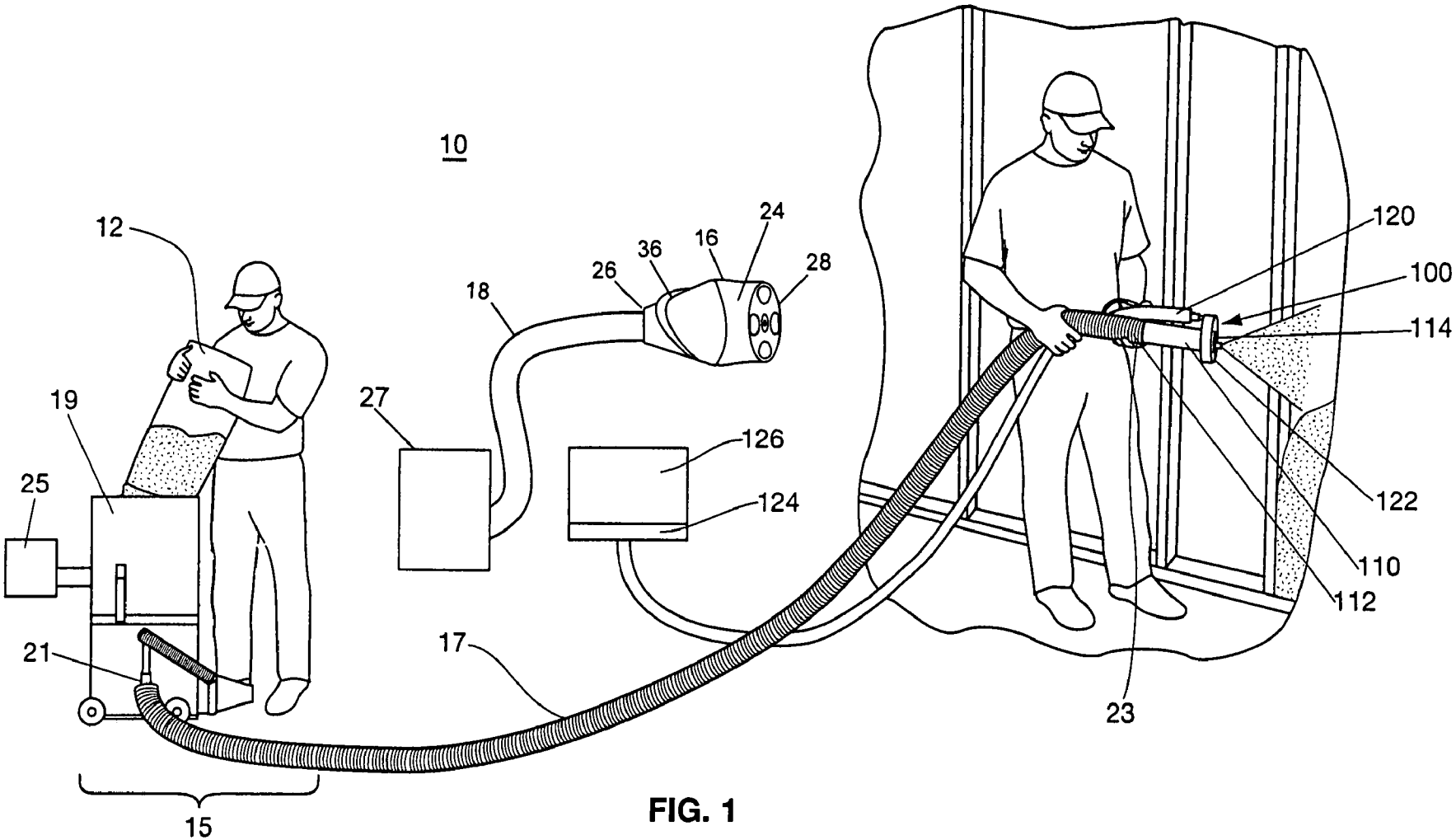
FIG. 1 is a schematic view of an insulation system constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, an insulation system, generally designated 10, is shown constructed according to the present invention. The insulation system 10 comprises: a supply of material 12 having discrete elements; an applicator assembly 100 for installation of the material 12 having discrete elements to a surface; a scrubber 16 for finishing the face of the material, wherein the scrubber includes a vacuum outlet 24 substantially adjacent the face of the material during finishing. The vacuum outlet 24 may include a vacuum source 27 attached to the vacuum outlet 24 for removing loose material 12 created during finishing. The vacuum source 27 may be any large commercial vacuum such as a Shop-Vac® brand wet/dry vac.

The system may further include a transporter system 15 downstream of the supply of material 12 having discrete elements for delivery of the material 12 to the applicator assembly 100. The transporter system 15 may include a conduit 17 with an inlet 21 and outlet 23; and an air supply 25 to move the material 12 having discrete elements through the conduit 17. The transporter system 15 may further include a debailer 19 for debailing bundles of the material 12 having discrete elements.

The scrubber for the system may include a positioner 36 attached to the vacuum conduit 18 for moving the apparatus with respect to the face of the material 12. The positioner 36, as best seen in FIG. 2, may include at least one handle.

The supply of material 12 having discrete elements for the insulation system 10 the may be selected from the group consisting of fibrous material, granular material, pellet material, agglomerated material, aggregated material and mixtures thereof. The supply of material 12 having discrete elements may be inorganic. The inorganic material may be selected from the group consisting of fiberglass, rock wool, pearlite, mineral wool, asbestos, and mixtures thereof. The supply of material 12 having discrete elements may be organic. The organic material may be a natural material. The natural material may be cellulosic. The supply of material 12 having discrete elements may be a non-conductive material. The supply of non-conductive material may be a thermally non-conductive material. The supply of non-conductive material may be an acoustically non-conductive material. The supply of non-conductive material may be an electrically non-conductive material.

The applicator assembly 100 for the insulation system 10 may include: a nozzle 110 having an inlet 112 for receiving the material 12 and an outlet 114 for applying the material 12 to a surface; and an adhesive applicator 120 adjacent to the nozzle 110 for activating a substantially water-free adhesive 126 to provide structure to the material 12 having discrete elements during installation. The adhesive applicator 120 may include a supply of adhesive material 126 and a spray head 122 for supplying adhesive 126 to the material 12 having discrete elements. The supply of adhesive 126 material may include a hot melt adhesive and a heater assembly 124. The hot melt adhesive may be a thermoplastic adhesive.

Figure 2:
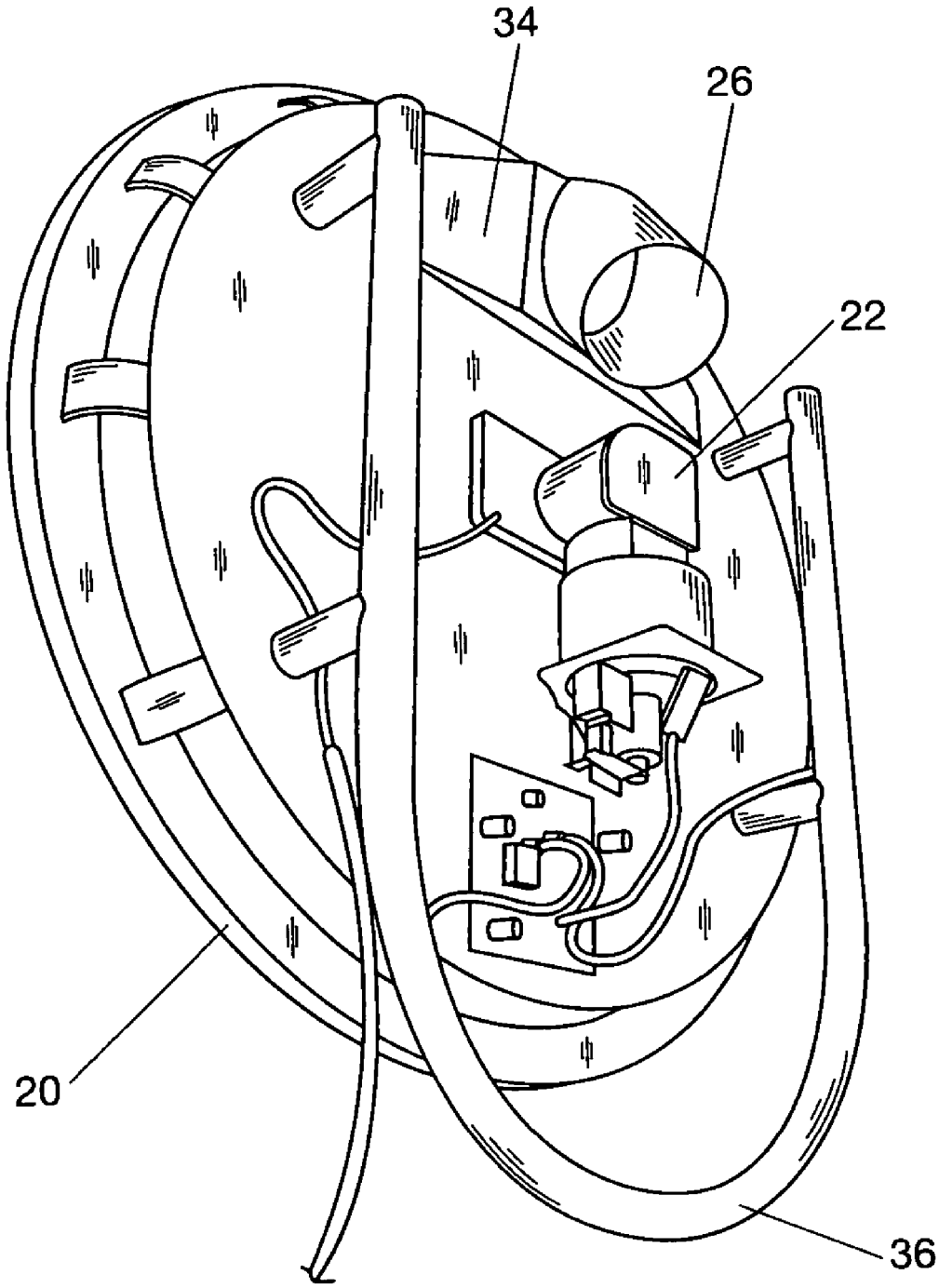
FIG. 2 is a top perspective view of a scrubber for finishing the face of a material having discrete elements.

FIG. 2 is a perspective of a scrubber 16 for finishing the face of a material 12 having discrete elements. The scrubber 16 comprises: a vacuum conduit 18; a blade assembly 20 attached to the vacuum conduit 18 comprising an axis of rotation substantially perpendicular to the face of the material during finishing; a drive 22 for the blade assembly 20; and a vacuum outlet 24 substantially adjacent the face of the material 12 during finishing. The drive 22 for the blade assembly 20 may be an external drive directly connected to the blade assembly or the drive 22 may be a belt drive such as a timing belt drive.

The vacuum conduit 18 of the scrubber 16 may include at least one inlet 28 and at least one outlet 26. The open area of the inlet 28 may be greater than the open area of the outlet 26. The conduit may further include a transition zone 34 between the inlet 28 and the outlet 26. The blade assembly 20 of the scrubber 16 may have contact surface substantially parallel to the face of the material 12 during finishing. The axis of rotation of the blade assembly 20 may be substantially perpendicular to the face of the material 12 during finishing.

Figure 3:
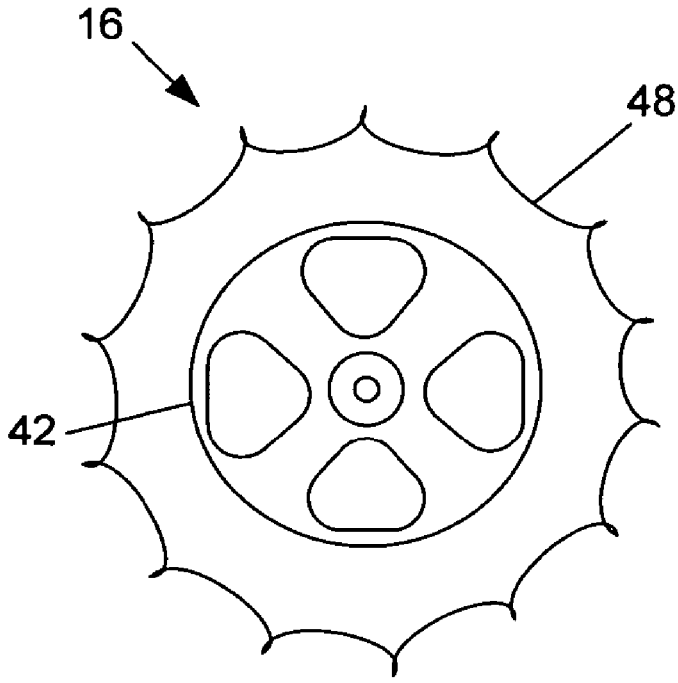
FIG. 3 is a bottom view of a scrubber for finishing the face of a material having discrete elements illustrating a preferred embodiment of the blade assembly.
Figure 4:
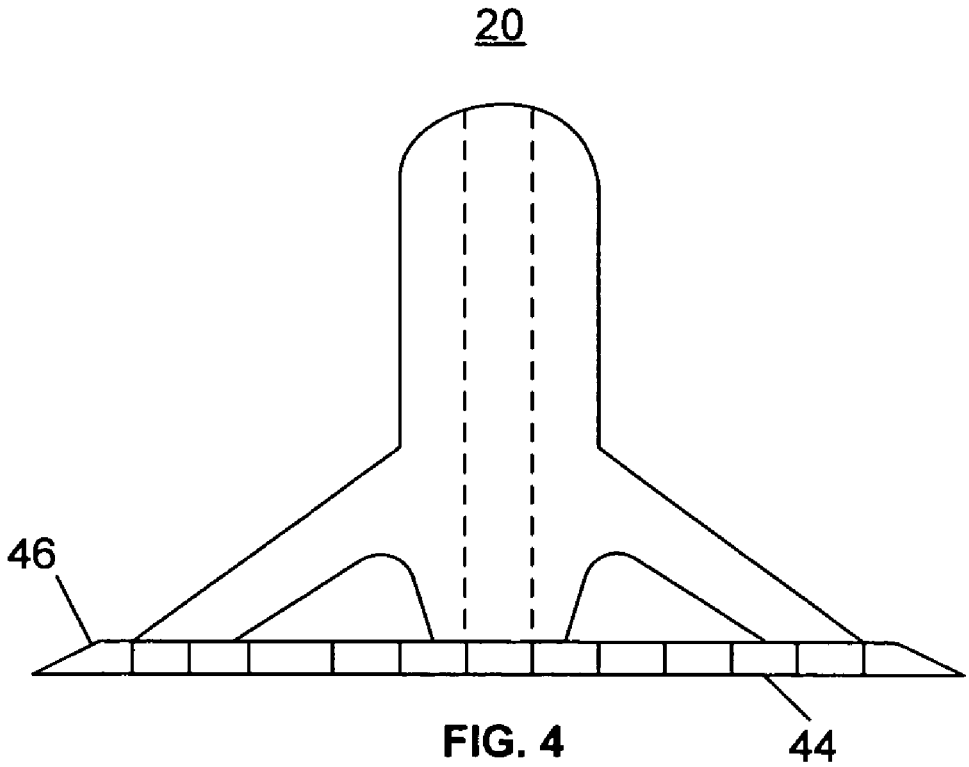
FIG. 4 is a side view of the blade assembly of a scrubber for finishing the face of a material having discrete elements.
Figure 5:
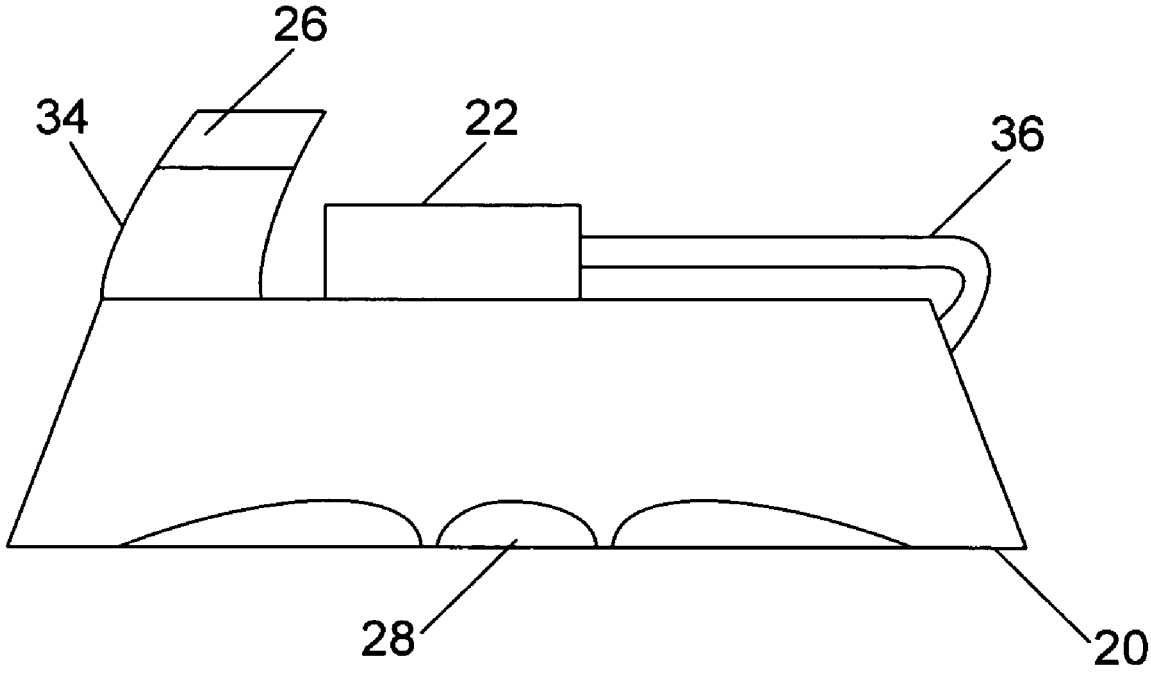
FIG. 5 is a longitudinal, cross sectional view of the scrubber for finishing the face of a material having discrete elements shown in FIG. 2.

FIG. 3 is a bottom view and FIG. 4 a side view of a blade assembly 20 for the scrubber 16. The blade assembly 16 may include scalloped edges 48. The blade assembly may include sidewall cutters 42. FIG. 4 shows an elastomeric surface 44 of the blade assembly 16, and angled edges 46, which, in one embodiment, the blade assembly 16 may also include. FIG. 5 further illustrates the present invention. FIG. 5 is a longitudinal, cross sectional view of the scrubber for finishing the face of a material having discrete elements shown in FIG. 2.

Certain modifications and improvements will occur to those skilled in the art upon a reading of the foregoing description. By way of example, safety, performance, and ergonomic improvements can be made to the apparatus. Using a handle as a positioner is one such example. In addition, ergonomic switches may be used with the apparatus. The blade assembly may be made of various performance enhancing materials such as rubber, plastic, metal, or combinations thereof. The speed may be adjusted through the use of switching attached to the unit. The blade assembly may also include spacing between the axle connection and the blade itself that is open to the vacuum attachment to facilitate the movement of air and the material having discrete elements into the vacuum inlet. The materials of construction may vary according to the engineering needs of the particular application. The drive may be a geared drive. The drive may be a direct drive. The drive may be a combination drive. The drive may be a flexible drive allowing separation of the motor and blade assembly, or separation of the motor and the blade/gear assembly combination. All other such modifications and improvements have been deleted herein for the sake of conciseness and readability but are properly within the scope of the following claims.

We claim:

1. An insulation system comprising:

(a) a supply of insulating material having discrete elements;

(b) an adhesive applicator assembly for installation of the material having discrete elements to a surface;

(c) a transporter system downstream of the supply of material having discrete elements for delivery of the material to the applicator assembly; and (d) a scrubber for finishing the face of the material, the scrubber including: (i) a vacuum conduit; (ii) a blade assembly attached to the vacuum conduit, the blade assembly comprising an axis of rotation substantially perpendicular to the face of the material during finishing, said blade assembly including a plurality of blades extending outwardly from the axis of rotation and to a planar blade attached to distal ends of said plurality of blades; (iii) a drive for the blade assembly; and (iv) a vacuum substantially adjacent the face of the material during finishing.

2. The insulation system according to claim 1, wherein, the transporter system includes a conduit with an inlet and outlet; and an air supply to move the material having discrete elements through the conduit.

3. The insulation system according to claim 2, wherein the transporter system further includes a debailer for debailing bundles of the material having discrete elements.

4. The insulation system according to claim 1, wherein the supply of material having discrete elements is selected from the group consisting of fibrous material, granular material, pellet material, agglomerated material, aggregated material and mixtures thereof.

5. The insulation system according to claim 1, wherein the supply of material having discrete elements is inorganic.

6. The insulation system according to claim 5, wherein the inorganic material is selected from the group consisting of fiberglass, rock wool, pearlite, mineral wool, asbestos, and mixtures thereof.

7. The insulation system according to claim 1, wherein the supply of material having discrete elements is organic.

8. The insulation system according to claim 7, wherein the organic material is a natural material.

9. The insulation system according to claim 8, wherein the natural material is cellulosic.

10. The insulation system according to claim 1, wherein the supply of material having discrete elements is a non-conductive material.

11. The insulation system according to claim 10, wherein the supply of non-conductive material is a thermally non-conductive material.

12. The insulation system according to claim 10, wherein the supply of non-conductive material is an acoustically non-conductive material.

13. The insulation system according to claim 10, wherein the supply of non-conductive material is an electrically non-conductive material.

14. The insulation system according to claim 10, wherein the supply of material comprises material that has been reclaimed and recycled through the insulation system.

15. The insulation system according to claim 1, wherein the applicator assembly includes: a nozzle having an inlet for receiving the material and an outlet for applying the material to a surface; and an adhesive applicator adjacent to the nozzle for activating a substantially water-free adhesive to provide structure to the material having discrete elements during installation.

16. The insulation system according to claim 15, wherein the adhesive applicator includes a supply of adhesive material and a spray head for supplying adhesive to the material having discrete elements.

17. The insulation system according to claim 16, wherein the supply of adhesive material includes a hot melt adhesive and a heater assembly.

18. The insulation system according to claim 17, wherein the hot melt adhesive is a thermoplastic adhesive.

19. The insulation system according to claim 1, wherein the vacuum conduit includes at least one inlet and at least one outlet.

20. The insulation system according to claim 19, wherein the open area of the inlet is greater than the open area of the outlet.

21. The insulation system according to claim 19, further including a transition zone between the inlet and the outlet.

22. The insulation system according to claim 1, wherein the blade assembly has contact surface substantially parallel to the face of the material during finishing.

23. The insulation system according to claim 22, wherein the axis of rotation of the blade assembly is substantially perpendicular to the face of the material during finishing.

24. The insulation system according to claim 1, wherein the blade assembly includes scalloped edges.

25. The insulation system according to claim 1, wherein the blade assembly includes sidewall cutters.

26. The insulation system according to claim 1, wherein the blade assembly includes an elastomeric surface.

27. The insulation system according to claim 1, wherein the blade assembly includes an angled edge.

28. The insulation system according to claim 1, wherein the drive is an external drive.

29. The insulation system according to claim 28, wherein the drive is a belt drive.

30. The insulation system according to claim 29, wherein the drive is a timing belt drive.

31. The insulation system according to claim 1, further including a positioner attached to the vacuum conduit for moving the apparatus with respect to the face of the material.

32. The insulation system according to claim 31, wherein the positioner includes at least one handle.

33. The insulation system according to claim 1, wherein the vacuum includes a vacuum source attached to the vacuum for removing loose material created during finishing.

* * * * *

UNITED STATES PATENT AND TRADEMARK OFFICE

CERTIFICATE OF CORRECTION

PATENT NO. : 7,300,521 B2 
APPLICATION NO. : 11/007641
DATED : November 27, 2007
INVENTOR(S) : Bowman et al.

It is certified that error appears in the above-identified patent and that said Letters Patent is hereby corrected as shown below:

Col. 3, line 17-19; please delete;
The following amendment to the specification was submitted June 18, 2007:

Figure 3 is a bottom view of a scrubber for finishing a face of a material having discrete elements illustrating a preferrred embodiment of the blade assembly.

and insert;

Figure 3 is a bottom view and Figure 4 a side view of a blade assembly 20 for the scrubber 16. The blade assembly 16 may include scalloped edges 48 around the outer peripheral edge of the ring attached to the distal ends of the blades. The blade assembly may include sidewall cutters 42. Figure 4 shows an elastomeric surface 44 of the blade assembly 16, and angled edges 46, which, in one embodiment, the blade assembly 16 may also include. Figure 5 further illustrates the present invention. Figure 5 is a longitudinal, cross sectional view of the scrubber for finishing the face of a material having discrete elements shown in Fig. 2.

Signed and Sealed this

Twenty-ninth Day of April, 2008

Jon W. Dudas

JON W. DUDAS
*Director of the United States Patent and Trademark Office*